United States Patent [19]

Carr et al.

[11] Patent Number: 4,625,875

[45] Date of Patent: Dec. 2, 1986

[54] TAMPER-EVIDENT CLOSURE

[76] Inventors: Joseph J. Carr, 1503 Bel Aire Ct. West, Point Pleasant, N.J. 07842; Thomas J. Angelini, 142 Imperial Ave., Pittsfield, Mass. 01201

[21] Appl. No.: 697,795

[22] Filed: Feb. 4, 1985

[51] Int. Cl.[4] ..... B65D 41/34

[52] U.S. Cl. ..... 215/232; 215/252

[58] Field of Search ..... 215/232, 252, 258

[56] References Cited

U.S. PATENT DOCUMENTS

| | | | |
|---|---|---|---|
| 3,632,004 | 1/1972 | Grimes | 215/232 |
| 4,180,175 | 12/1979 | Virog et al. | 215/252 |
| 4,461,391 | 7/1984 | Davis | 215/252 |
| 4,479,586 | 10/1984 | Csaszar | 215/252 X |
| 4,505,401 | 3/1985 | Berglund | 215/252 |
| 4,523,689 | 6/1985 | Laub | 215/232 |

FOREIGN PATENT DOCUMENTS

| | | | |
|---|---|---|---|
| 500032 | 2/1954 | Canada | 215/232 |

*Primary Examiner*—Donald F. Norton

*Attorney, Agent, or Firm*—Louis E. Marn

[57] ABSTRACT

There is disclosed a tamper-evident closure including a depending tamper-evident skirt member capable of being positioned by longitudinal force (i.e. pushed on) onto a neck of a container including a skirt collar wherein the closure is formed with an internal thread and the neck of the container is formed with an external thread and wherein the tamper-evident depends by angularly-formed arm members from the closure, and wherein the threads are of multiple courses and wherein a groove of the skirt member of the closure engages the skirt collar of the container in an assembled relationship of the closure to the container.

18 Claims, 6 Drawing Figures

TAMPER-EVIDENT CLOSURE

FIELD OF THE INVENTION

This invention relates to tamper-evident closures, and more particularly to a tamper-evident container having a frangible portion and capable of being positioned on a neck of a container by longitudinal movement of the tamper-evident closure with respect to the axis of the neck of the container with nominal twisting motion, if any.

BACKGROUND OF THE INVENTION

Both plastic and metal closures for various bottles and containers which include a tamper-evident feature have been known for many years. In most cases, this tamper-evident feature comprises a lower shoulder or skirt portion of the closure which is in some way intended to fracture or break upon removal of the closure from the container, so that it then becomes evident that the container has been opened. While a large number of these closures have been known in the past, on a commercial basis, and particularly in connection with soda bottles and other such containers maintained under significant pressures, up until quite recently metal closures have predominated. These include closures such as shown in U.S. Pat. No. 3,812,991 which issued on May 28, 1974 to the Coca Cola Company, and many others.

The many problems encountered in connection with the use of metal closures, however, have been significant. They primarily relate to the fact that in an unacceptably large proportion of cases, removal of the closure does not result in a clean and efficient fracture of the lower skirt portion, therefore making removal of the closure quite difficult and/or completely eliminating the tamper-evident feature. In addition, the cost of metal closures has recently increased dramatically, and the search for efficient plastic closures has therefore intensified.

In connection with plastic closures of this type, again a large number have been known in the past, but no commercial closure has been found which can be applied in a single step to the container or bottle, (i.e. such closures generally require a two-step application procedure), and can at the same time result in efficient breaking or fracturing upon its removal. One recent commercial closure which is now widely utilized is that of U.S. Pat. No. 4,033,472 to Albert Obrist AG, which issued on July 5, 1977. Such closure, however, again suffers from both of these infirmities. In the first place, it requires a two-step application procedure, i.e., initial application of the closure to the bottle followed by a heating process whereby the lower depending bead 4 is deformed against the surface of the bead or collar on the bottle itself, as shown in FIG. 4 thereof. In addition, it has again been found that such closures, although used commercially, do not fracture properly in an unacceptable proportion of cases. Several other issued patents which include such two-step application procedures include U.S. Pat. No. 3,673,761 assigned to Ciba-Geigy AG, and U.S. Pat. No. 3,788,509 to Keeler, which includes a separate heating step for producing the weakened zones themselves.

Among those patents which do show a one-piece plastic closure, which does not require such a heal sealing step, are those to Hamberger, namely U.S. Pat. Nos. 2,162,711 and 2,162,712. These patents, however, are directed to closures which include a weakened portion defined by corresponding grooves on the shoulder portion (see FIG. 1 thereof) of the depending skirt 23. In such closures, fracturing thus occurs in a vertical direction with respect to the closure, and tangentially with respect to the lugs 18 to which the skirt is attached. In addition, the skirt portion in this patent appears to be constructed so as to be thinner than the upper walls thereof. Additional such closures are also shown in the Schauer patents, namely U.S. Pat. Nos. 2,162,752 and 2,162,754. None of these patents thus teach the structure of a commercially acceptable product.

There are yet another group of patents directed to such closures which rely upon interlocking teeth or serrations in order to effect the fracture of the closure. For example, French Pat. No. 1,347,895 includes a ratchet or lug means on the breakaway skirt portion 2 thereof as well as on the bottle bead, and German Pat. No. 2,349,265 also includes lugs 16 which extend inwardly from depending skirt 13 to aid in fracturing at the point of weakness thereon. Reference in this regard is also made to U.S. Pat. Nos. 3,980,195, 3,924,769 and 4,126,240.

In U.S. Pat. No. 4,343,408 to Psaszar there is disclosed a tamper-evident plastic closure which allegedly obviates certain problems of the prior art, and may be applied to the neck of the container in a one-step twisting operation. All of the heretofore tamper-evident closures having internal threads for threadable engagement with a neck having extended threads of a container have required the threading of the closure onto the neck thereof with certain concomitant problems. If an excess of rotational force is used, the closure may fracture thereby permitting subsequent leakage of the contents thereof, or may present problems in removing the closure from the container. Obviously, if less than an appropriate rotational force is used, leakage, or reduced shelf life, etc., may result. Additionally, assemblies for positioning and twisting closures onto necks of containers are complicated and require constant maintenance to insure proper processing of the closure onto the neck of the container.

OBJECTS OF THE INVENTION

It is an object of the present invention to provide a novel tamper-evident closure having internal threads for positioning by longitudinal movement onto a neck of a container having external threads.

Yet another object of the present invention is to provide a novel tamper-evident closure having internal threads for positioning by longitudinal movement onto a neck of a container having external threads thereafter requiring nominal, if any, twisting of the closure with respect to the container.

Still another object of the present invention is to provide a novel tamper-evident closure having internal threads for positioning by longitudinal movement onto a neck of a container having external threads and having a sealing member including tab to insure content integrity.

A further object of the present invention is to provide a novel tamper-evident closure having internal threads for positioning by longitudinal movement onto a neck of a container having external threads and provided with a tamper-evident skirt readily separated from the closure by twisting the closure in an opening relationship with respect to the container.

A still further object of the present invention is to provide a novel tamper-evident closure having internal threads for positioning by longitudinal movement onto a neck of a container having external threads and formed with a tamper-evident skirt with spring-like action to minimize fracturing of the closure or container during positioning of the closure on the neck of the container.

SUMMARY OF THE INVENTION

These and other objects of the present invention are achieved by a tamper-evident closure including a depending tamper-evident skirt member capable of being positioned by longitudinal force (i.e. pushed on) onto a neck of a container including a skirt collar wherein the closure is formed with an internal thread and the neck of the container is formed with an external thread and wherein the tamper-evident skirt member depends by angularly-formed arm members from the closure, and wherein the threads are of multiple courses and wherein a groove of the skirt member of the closure engages the skirt collar of the container in an assembled relationship of the closure to the container.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein.

DETAILED DESCRIPTION OF THE INVENTION

Figure 1:
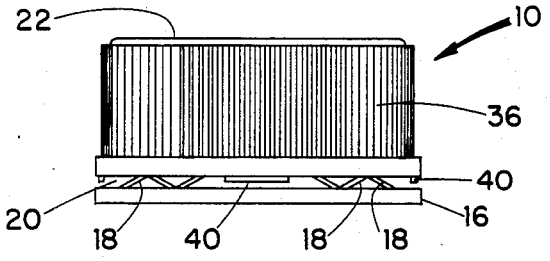
FIG. 1 is an elevational view of one embodiment of the tamper-evident closure of the present invention.
Figure 2:
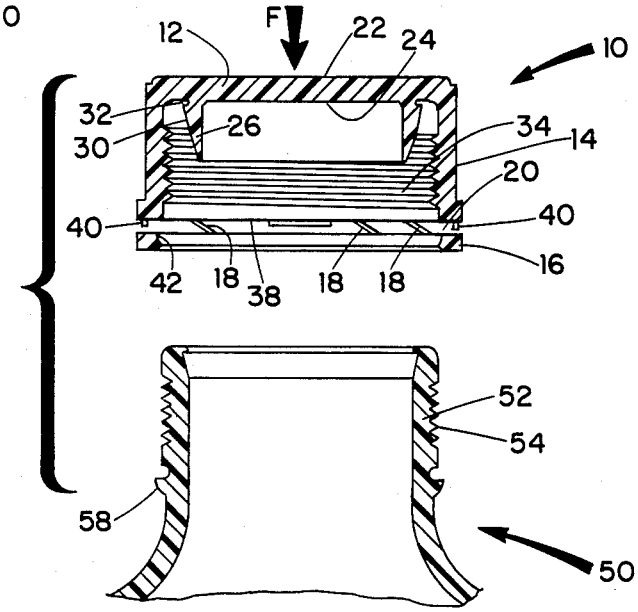
FIG. 2 is an exploded cross-sectional view thereof positioned above a neck of a container therefor.

Referring to FIGS. 1 and 2 of the drawings wherein like numerals indicate like parts throughout, there is illustrated a tamper-evident closure, generally indicated as 10 comprised of an upper end wall 12, a cylindrically-shaped side wall 14 and a ring-shaped tamper-evident skirt member 16 depending from the cylindrically-shaped side wall 14 by a plurality of arm members 18 angularly-disposed with reference to a center axis of the closure 10 thereby forming a ring-shaped opening 20 between the cylindrically-shaped side wall 14. The closure member 10 is formed of a suitable thermoplastic material, such as low density polyethylene or like thermoplastic materials possessing certain characteristics of flexibility, as will hereinafter become more apparent. The arm members 18 are configured and angularly-disposed to provide a spring-like action between the skirt member 16 with the upper body portion of the closure 10.

The end wall 12 of the closure 10 is comprised of an outer surface portion 22 and an inner surface portion 24 including a cylindrically-shaped internal centering element 26 depending inwardly essentially coincident to the cylindrically-shaped side wall 14 to facilitate centering as more fully hereinafter discussed. An outer surface portion 30 of the internal centering element 26 proximate the inner surface portion 22 of the end wall 14 is provided with a groove 32, as more fully hereinafter discussed.

The cylindrically-shaped side wall 14 is formed with an internal thread 34 and with a knurled or serrated outer surface portion 36 to facilitate in closure removal and closure tightening as more fully hereinafter discussed. An end surface portion 38 of the cylindrically-shaped side wall 14 at an end thereof opposite the end wall 12 is formed with a plurality of wall sections 40 extending partially into the opening 20.

The ring-shaped tamper-evident skirt member 16 is formed with an internal groove 42, as more fully hereinafter discussed. In a particularly preferred embodiment of the present invention, the external diameter of the skirt member 16 is substantially equal to the external diameter of the closure 10, and essentailly equal to the external diameter of a knurled portion 36 of the closure 10 thereby simplifying bottling assembly requirements.

The closure 10 cooperates with a container, generally indicated as 50 (e.g. a one gallon milk container), referring particularly to FIG. 2, including a neck portion 52 including external threads 54, an inwardly extending lip portion 56 on an inner portion thereof and a skirt ridge or collar 58 formed on an external surface thereof.

The internal threads 34 of the closure 10 and the external threads 54 of the container 50 are preferably of the multiple thread type and more preferably of the triple thread type whereby the closure 10 assumes a level position of substantially coaxial alignment with the axis of the container 50 when disposed on the neck 52 of the container. After such positioning, a longitudinal force (as indicated by the arrow F) referring to FIG. 2 may be applied to the closure 10 to force the closure 10 onto the neck 52 of the container 50, i.e. the closure 10 is pushed onto the neck 52 of the container 50 to a point where the internal groove 42 formed in the skirt member 16 cooperates with the ridge or collar 58 formed on the neck 52 of the container 50. During downward movement of the closure 10, the wall sections 40 contact an upper surface portion of the skirt member 16 to assist in positioning of the skirt member 16 about the ridge or collar 58 in a tamper-evident mode, i.e. the closure 10 may not now be removed from the container 50 without fracturing the arm members 18 and thereby retains the tamper-evident skirt member 16 about the neck portion 52 of the container 50. Additionally, the inwardly extending lip 56 cooperates with groove 32 of the closure 10 to provide for additional closure integrity between the closure 10 and the container 50, particularly for uses relating to carbonate beverage bottling.

The provision for the opening 20 of the closure 10 wherein the wall sections 40 cooperate with the upper surface portion of the skirt 16 permits facile positioning of the closure 10 on the container 50 while minimizing the potential of damage to the arm members 18 of the closure 10. It is apparent to one skilled in the art that subsequent positioning, i.e. by pushing the closure 10 onto the neck 52 of the container 50 may not result in the complete cooperation in fluid tight interrelationship of the closure 10 with the container 50, and thus as a step in the bottling protocol requires a slight twisting of the closure 10 with respect to the container 50.

Figure 5:
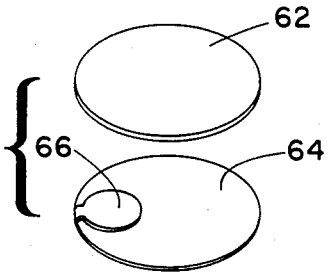
FIG. 5 is an exploded view of the container seal assembly.
Figure 3:
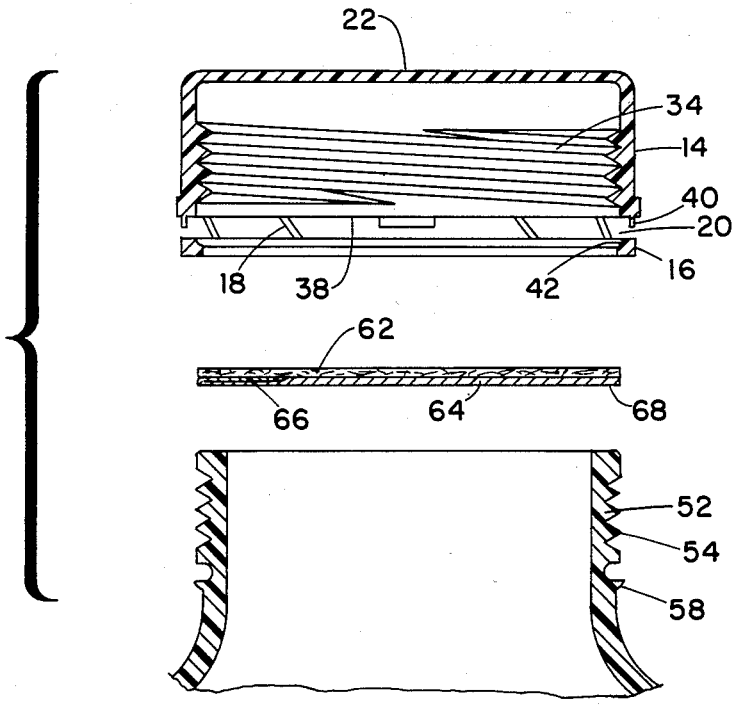
FIG. 3 is an exploded cross-sectional view of a tamper-evident closure of another embodiment of the present invention positioned above a container including a container seal assembly.
Figure 4:
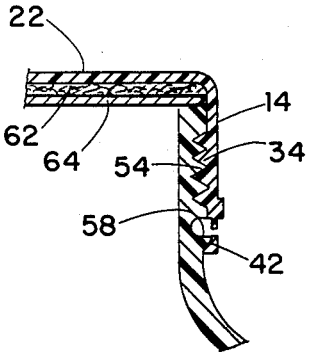
FIG. 4 is a partial cross-sectional view of the embodiment of FIG. 3 mounted on the neck of the container.

In FIGS. 3 and 4, there is illustrated a closure of the present invention without a centering element 26 including a sealing assembly, generally indicated as 60, referring particularly to FIG. 5, comprised of a cardboard disc 62 and a metal or foil disc 64 including a tab member 66. A surface 68 of the foil cap 64 opposite the surface in contact with the cardboard disc 62 is provided with an adhesive coating. In the bottling protocol, a sealing assembly 60 is placed on the container 50 after filling of the container 50 and closure positioning are subsequently effected (longitudinal force "F") including the step of ensuring closure integrity (i.e. final twisting of the closure 10 on the container 50) whereby the surface 68 including adhesive coating of the foil disc 64 is forced against the top of the neck 52 in sealing interrelationship. It will be understood by one skilled in the art that the bottling protocol may include an alternate step of positioning the sealing assembly 60 in a closure 10 followed by final assembly of the closure 10 to the container 50.

Figure 6:
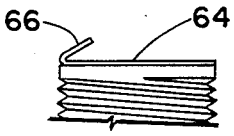
FIG. 6 is a partial elevational view of a foil seal including tab mounted on a neck of a container.

Upon removal of the closure 10 from the container 50 including fracturing of the arm members 18, a foil cap-container configuration is obtained as illustrated in FIG. 6 with the tamper-evident skirt remaining on the neck 52 of the container 50. The foil disc 64 including tab 66 thus sealed on the upper surface of the neck portion 52 of the container 50 ensures product integrity. The tab 66 permits ready removal of the foil disc 64 from the neck 52 of the container 50 for dispensing of the contents from the container 50.

While the closure 10 and container 50 have been described as preferably being formed of multiple threads of the triple lead type, it is understood that more or less number of threads may be formed therein limited in number by the size and diameter of the container 50 and the closure member 10 therefor. For example, a quadruple thread type for a closure for a usual gallon milk container reaches the limit of molding capabilities whereas a multiple thread type having more than four courses could be used for larger capacity containers. A single type thread would not ensure initial aligned positioning of the closure 10 on the container 50 with resulting thread depth essentially not permitting facile push-on positioning of the closure 10 onto the container 50, as hereinabove discussed.

While the invention has been described in connection with an examplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalent thereof.

What is claimed:

1. A tamper-evident closure for use in connection with a container including a threaded neck portion and an annular collar portion below said threaded neck portion which comprises:

a one-piece closure body including an upper closure portion comprised of an end wall and a cylindrical side wall, said cylindrical side wall including an internally threaded upper portion, a depending lower skirt portion, and flexible arm members formed between said closure body and said lower skirt portion defining an opening therebetween, said internally threaded upper portion of said closure being formed of a triple thread type and cooperating with said threaded neck portion of said container, said threaded neck portion of said container being of a cooperating triple thread configuration to thereby permit axial positional alignment of said closure on said threaded neck portion of said container prior to positioning of said closure on said threaded neck portion of said container by a downward force on said closure, said upper closure portion being formed with intermediate wall portions depending downwardly into said opening in said spaced-apart relationship to said depending lower skirt portion, said depending lower skirt portion including an inwardly projecting bead adapted to engage said annular collar portion of said container when said closure is positioned in fluid tight relationship to said container, said intermediate wall portions contacting said depending lower skirt portion during downward movement and thus positioning said closure onto said threaded neck portion of said container to thereby cause said inwardly projecting bead of said depending lower skirt portion to engage said annular collar portion of said container, said flexible members permitting relative longitudinal contacting movement between said upper closure portion and said depending lower skirt portion during positioning of said closure on said container and being fracturable to thereby leave said depending lower skirt portion on said container after said upper closure portion of said closure is unthreaded from said container.

2. The tamper-evident closure as defined in claim 1 including a sealing disc having an adhesive coating disposed in said upper closure portion for forming a seal on said container when said closure is positioned in fluid tight relation on said container.

3. The tamper-evident closure as defined in claim 2 wherein said sealing disc is formed with a tab.

4. The tamper-evident closure as defined in claim 2 or 3 wherein said sealing disc is comprised of a yieldable material.

5. The tamper-evident closure as defined in claim 4 wherein said yieldable material is metal foil.

6. The tamper-evident closure as defined in claim 2 and further including a second sealing disc disposed between said end wall of said closure and said sealing disc.

7. The tamper-evident closure as defined in claim 1 wherein an outer surface portion of said upper closure portion is serrated.

8. The tamper-evident closure as defined in claim 1 wherein said arm members are angularly-disposed with respect to said upper closure.

9. The tamper-evident closure as defined in claim 1 wherein an external diameter of said lower skirt portion is substantially equal to an external diameter of said upper body portion of said closure.

10. The novel closure-container assembly as defined in claim 9 including a sealing disc having an adhesive coating disposed in said upper closure portion for forming a seal on said container when said closure is positioned in fluid tight relation on said container.

11. The novel closure-container assembly as defined in claim 10 wherein said sealing disc is formed with a tab.

12. The novel closure-container assembly as defined in claim 10 or 11 wherein said sealing disc is comprised of a yieldable material.

13. The novel closure-container assembly as defined in claim 12 wherein said yieldable material is metal foil.

14. The novel closure-container assembly as defined in claim 10 and further including a second sealing disc disposed between said end wall of said closure and said sealing disc.

15. The novel closure-container assembly as defined in claim 9 wherein an outer surface portion of said upper closure portion is serrated.

16. The novel closure-container assembly as defined in claim 9 wherein said arm members are angularly-disposed with respect to said upper closure.

17. A novel closure-container assembly comprised of:

a container including a threaded neck portion having a triple thread configuration and an annular collar portion below said threaded neck portion; and a one-piece closure body including an upper closure portion comprised of an end wall and a cylindrical side wall, said cylindrical side wall including an internally threaded upper portion, a depending lower skirt portion, and flexible arm members formed between said closure body and said lower skirt portion defining an opening therebetween, said internally threaded upper portion of said closure being formed of a triple thread type and cooperating with said triple thread configuration of said threaded neck portion of said container to thereby permit axial positional alignment of said closure on said threaded neck portion of said container prior to positioning of said closure on said threaded neck portion of said container by a downward force on said closure, said upper closure portion being formed with intermediate wall portions depending downwardly into said opening in spaced-apart relationship to said depending lower skirt portion, said depending lower skirt portion including an inwardly projecting bead adapted to engage said annular collar portion of said container when said closure is positioned in fluid tight relationship to said container, said intermediate wall portions contacting said depending lower skirt portion during downward movement and thus positioning said closure on said threaded neck portion of said container to thereby cause said inwardly projecting bead of said depending lower skirt portion to engage said annular collar portion of said container, said flexible arm members permitting closing relative longitudinal movement between said upper closure portion and said depending lower skirt portion during positioning of said closure in said container and being fracturable thereby to leave said depending lower skirt portion on said container after said upper closure portion of said closure is unthreaded from said container.

18. The novel closure-container assembly as defined in claim 17 wherein an external diameter of said lower skirt portion is substantially equal to an external diameter of said upper body portion of said closure.

* * * * *